US008508909B2

(12) United States Patent
Nishikawa et al.

(10) Patent No.: US 8,508,909 B2
(45) Date of Patent: Aug. 13, 2013

(54) DUCT FRAME AND ION GENERATING DEVICE

(75) Inventors: Akimasa Nishikawa, Kawasaki (JP); Hideyuki Fujikawa, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 28 days.

(21) Appl. No.: 13/422,977

(22) Filed: Mar. 16, 2012

(65) Prior Publication Data

US 2012/0257319 A1 Oct. 11, 2012

(30) Foreign Application Priority Data

Apr. 5, 2011 (JP) ..... 2011-084099

(51) Int. Cl.
*H01H 47/00* (2006.01)

(52) U.S. Cl.
USPC ..... 361/231; 361/220

(58) Field of Classification Search
USPC ..... 361/212, 220, 231
See application file for complete search history.

(56) References Cited

U.S. PATENT DOCUMENTS

2005/0047056 A1* 3/2005 Huang ..... 361/212
2009/0314164 A1* 12/2009 Yamashita et al. ..... 96/245

FOREIGN PATENT DOCUMENTS

JP 2009-036411 A 2/2009

* cited by examiner

*Primary Examiner* — Danny Nguyen
(74) *Attorney, Agent, or Firm* — Maschoff Brennan

(57) ABSTRACT

A duct frame includes: a first airflow path configured to include a first outlet; a second airflow path configured to include a second outlet disposed close to the first outlet; an ion generator configured to be provided in the second airflow path and to divide the second airflow path into a first divided flow path and a second divided flow path; and a minute flow path configured to provide under the ion generator and to have a flow path resistance higher than the flow path resistance of the first divided flow path of the second airflow path.

8 Claims, 7 Drawing Sheets

DUCT FRAME AND ION GENERATING DEVICE

CROSS-REFERENCE TO RELATED APPLICATION

This application is based upon and claims the benefit of priority of the prior Japanese Patent Application No. 2011-84099, filed on Apr. 5, 2011, the entire contents of which are incorporated herein by reference.

FIELD

The embodiment discussed herein is related to a duct frame that guides the airflow in a device such as an ion generating device.

BACKGROUND

There are ion generating devices for releasing ions into the air and controlling the quality of the air. Ion generating devices supply ions generated in an ion generator to an airflow path such as a duct and thereby release air containing ions (see, for example, Japanese Laid-open Patent Publication No. 2009-36411).

Disposing an ion generator in a duct in order to ionize air flowing through the duct increases the pressure loss in the duct and reduces the blowing efficiency. For this reason, a large air blower may be provided. A large air blower makes a loud operating noise and a loud airflow noise. If an ion generator is disposed outside the duct, a space occupied by the ion generator may be secured outside the duct. This increases the size of the ion generating device.

Many of ion generators generate ions using moisture extracted by cooling air, and have a cooler for cooling air. For this reason, ion generators include a radiating portion of the cooler, and the radiating portion is supplied with an airflow.

The development of a duct frame that can efficiently blow air and release ions while radiating heat of a radiating portion of a cooler in an ion generating device, is desired.

SUMMARY

According to an aspect of the invention, a duct frame includes a first airflow path configured to include a first outlet; a second airflow path configured to include a second outlet disposed close to the first outlet; an ion generator configured to be provided in the second airflow path and to divide the second airflow path into a first divided flow path and a second divided flow path; and a minute flow path configured to provide under the ion generator and to have a flow path resistance higher than the flow path resistance of the first divided flow path of the second airflow path.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENT

Next, the embodiment will be described with reference to the drawings.

Figure 1:
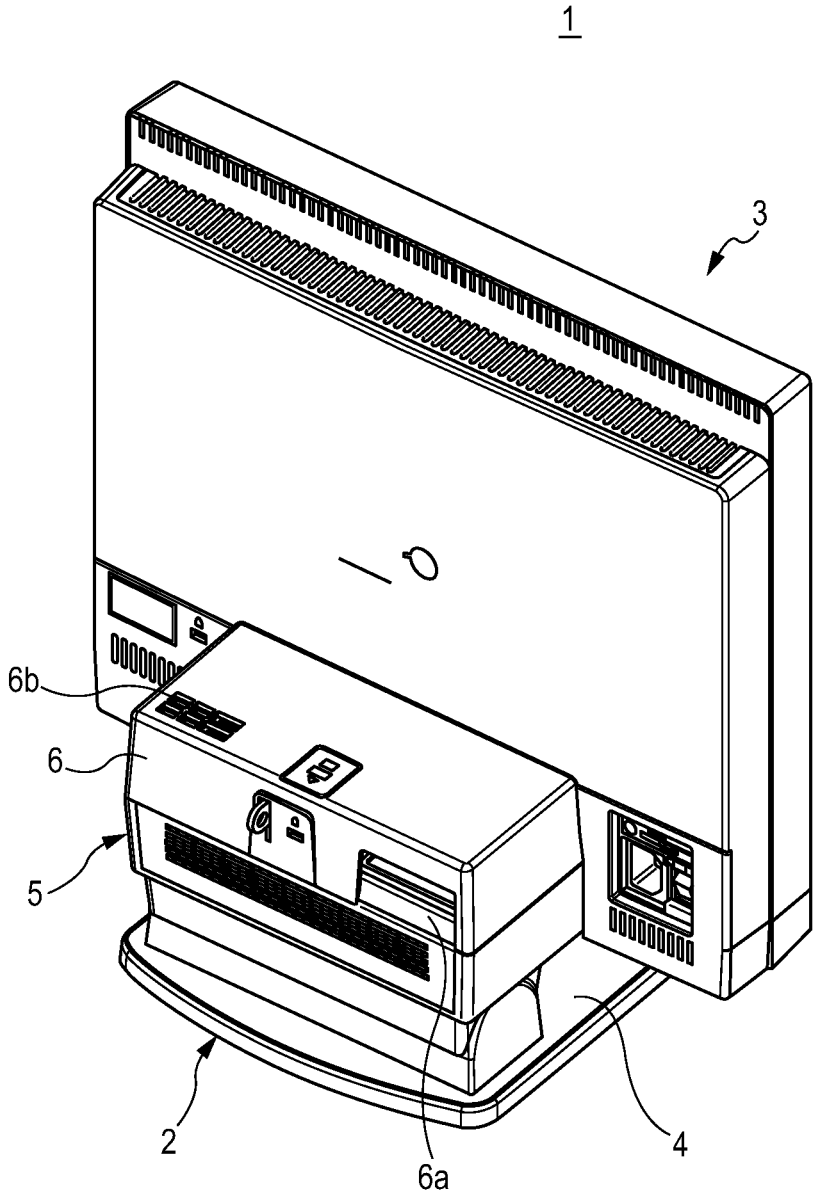
FIG. 1 is a perspective view of a display monitor apparatus that incorporates an ion generating device having a duct frame according to the embodiment.

FIG. 1 is a perspective view of a display monitor apparatus that incorporates an ion generating device having a duct frame according to the embodiment. Apparatuses that incorporate an ion generating device are not limited to display monitor apparatuses. An ion generating device can be incorporated in any apparatus such as various electronic apparatuses for home use or for office use.

A display monitor apparatus 1 includes a base portion 2 and a display portion 3 attached to the base portion 2. FIG. 1 illustrates the display monitor apparatus 1 as viewed from the rear. In FIG. 1, the rear of the display portion 3 is illustrated. The display portion 3 is a display device employing, for example, a liquid crystal panel. The rear of the display portion 3 is attached to the base portion 2.

The base portion 2 has a table 4 and a main body 5 provided on the top of the table 4. The main body 5 houses therein an electronic circuit board on which a circuit is formed that drives and controls the liquid crystal panel of the display portion 3, and accompanying electric components. On the top of the main body 5, a security cover 6 is provided. The security cover 6 covers and conceals connectors and others provided on the display monitor apparatus 1. The security cover 6 is a cover provided for suppressing unauthorized use of the display monitor apparatus 1 through the connectors.

Figure 2:
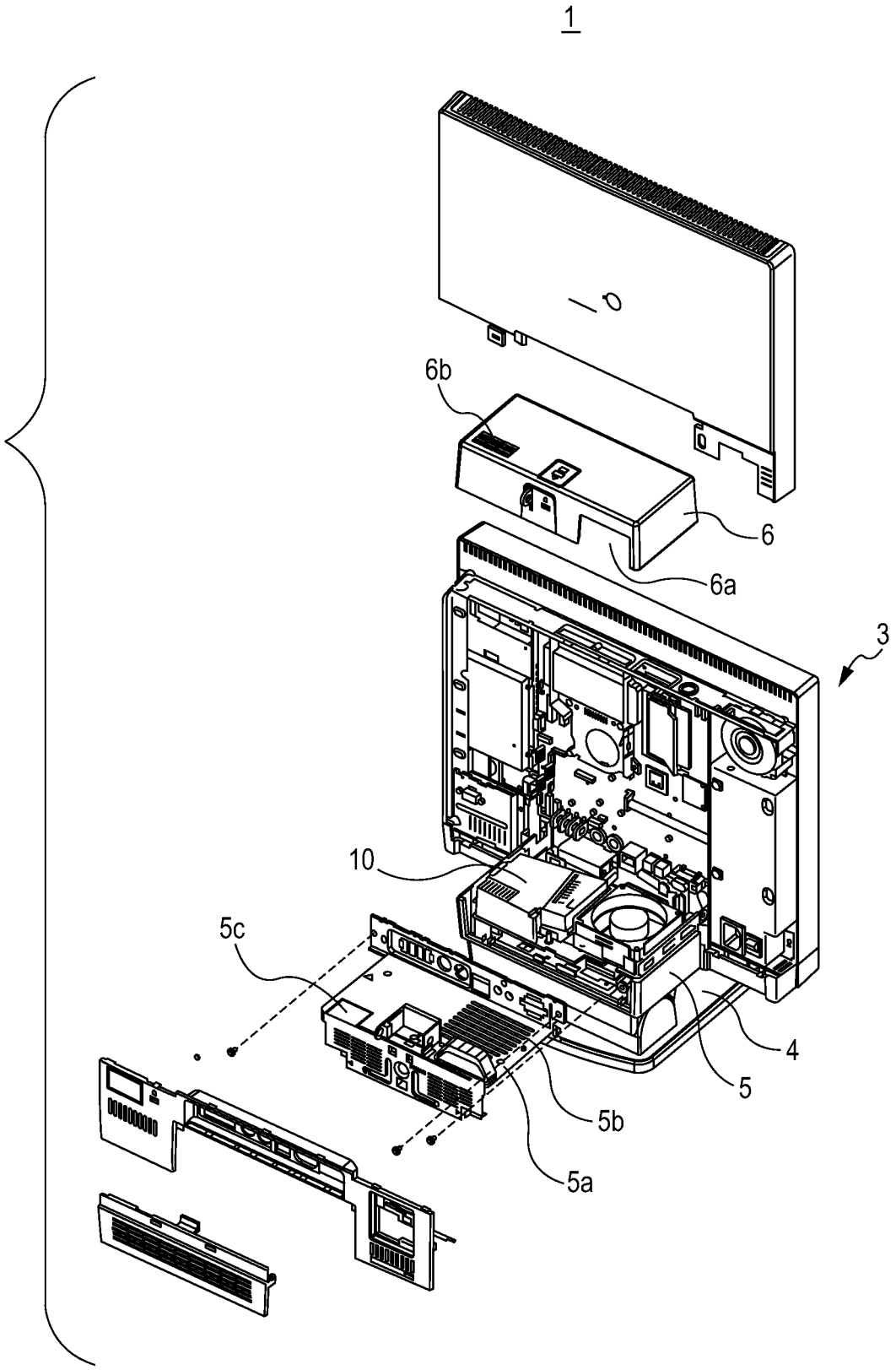
FIG. 2 is an exploded perspective view of the display monitor apparatus illustrated in FIG. 1.

FIG. 2 is an exploded perspective view of the display monitor apparatus 1. The ion generating device 10 is housed in the main body 5. On the top of the ion generating device 10, a main body cover 5*a* is provided. To the top of the main body cover 5*a*, the security cover 6 is attached. The security cover 6 is provided with an inlet 6*a*, and air can be supplied through the inlet 6*a* to the internal space of the security cover 6.

The ion generating device 10 housed in the main body 5 sucks in air in the internal space of the security cover 6 through an inlet 5*b* of the main body cover 5*a* and releases the sucked air together with ions generated in the ion generating device 10. The air containing ions is released through an outlet 5*c* of the main body cover 5*a* and an outlet 6*b* of the security cover 6 to the environment.

Figure 3:
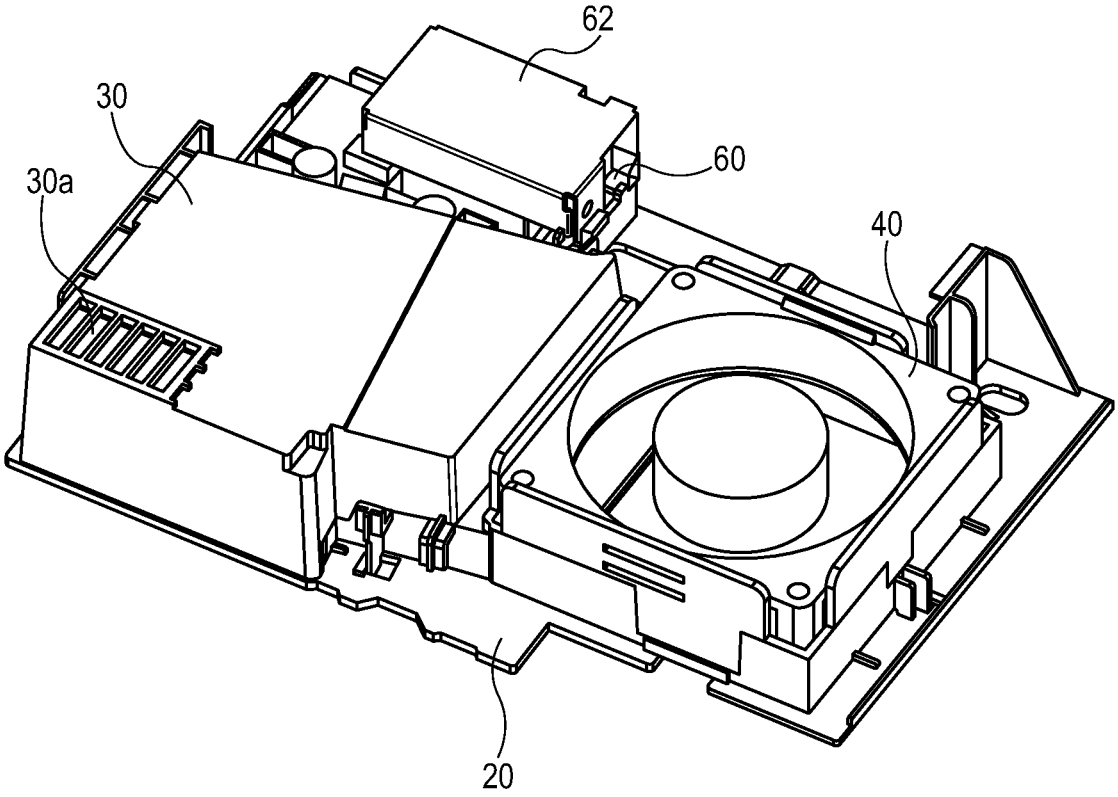
FIG. 3 is a perspective view of the ion generating device having the duct frame according to the embodiment.
Figure 4:
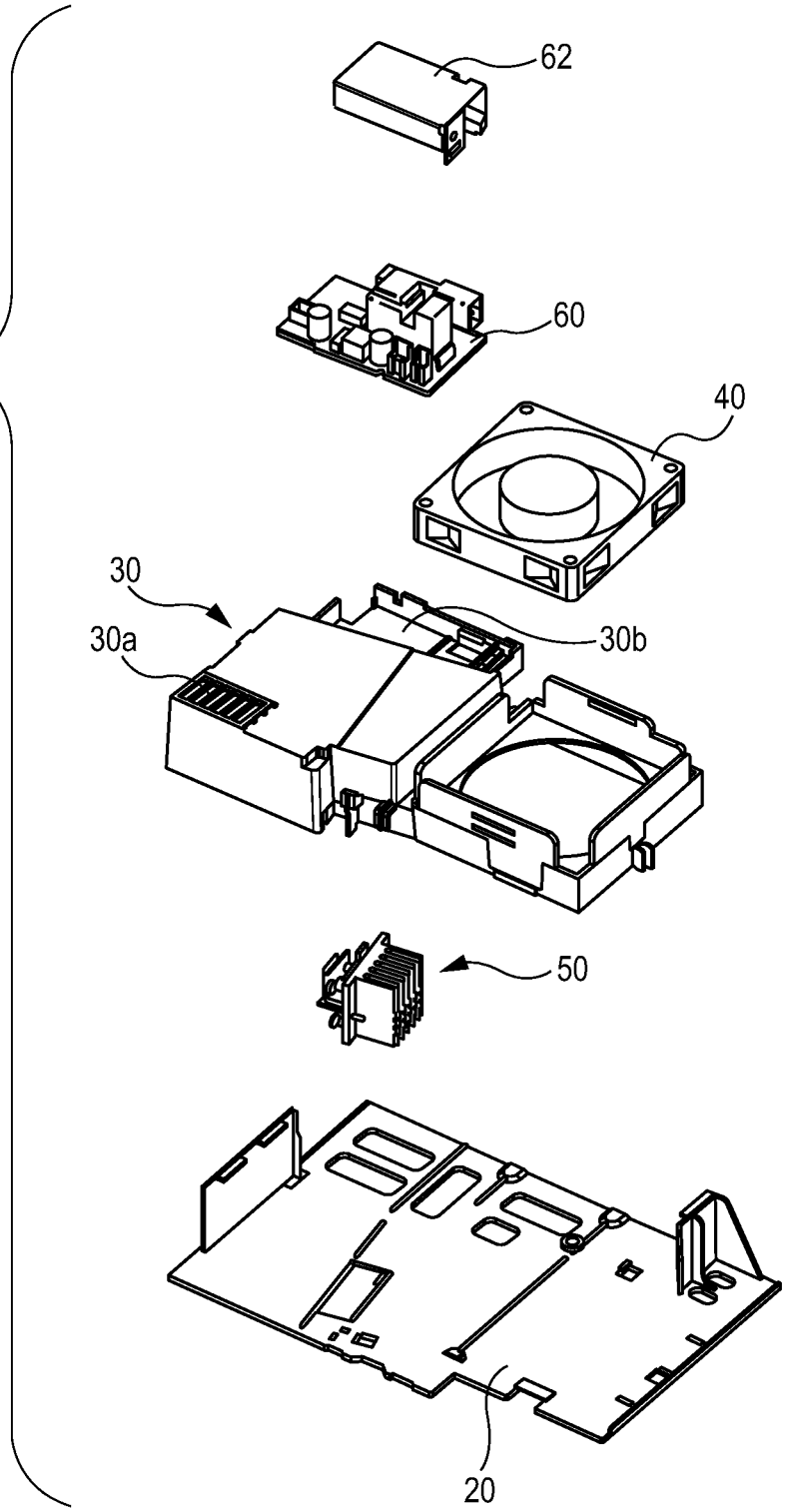
FIG. 4 is an exploded perspective view of the ion generating device.

FIG. 3 is a perspective view of the ion generating device 10, and FIG. 4 is an exploded perspective view of the ion generating device 10. The ion generating device 10 includes a base 20 and a cover 30. The base 20 is a plate-like member, to the top of which the cover 30 is attached. As described later, an ion generator 50 and a duct frame are provided inside the cover 30, and ions generated in the ion generator 50 are released from the cover 30 together with air flowing through the duct frame.

As an air blower, a fan 40 is attached to the cover 30. By driving the fan 40, air can be caused to flow through the duct frame (airflow paths) formed inside the cover 30. Air supplied to the duct frame inside the cover 30 is released through an outlet 30*a* formed in the cover 30, and is released through the outlet 5*c* of the main body cover 5*a* and the outlet 6*b* of the security cover 6 to the environment as described above.

A board attachment portion 30*b* extends from the cover 30. A control board 60 provided with a control circuit that controls the operation of the ion generating device 10, and other electric components are mounted on the board attachment portion 30*b*. The control board 60 is covered and shielded by a shield cover 62.

Figure 5:
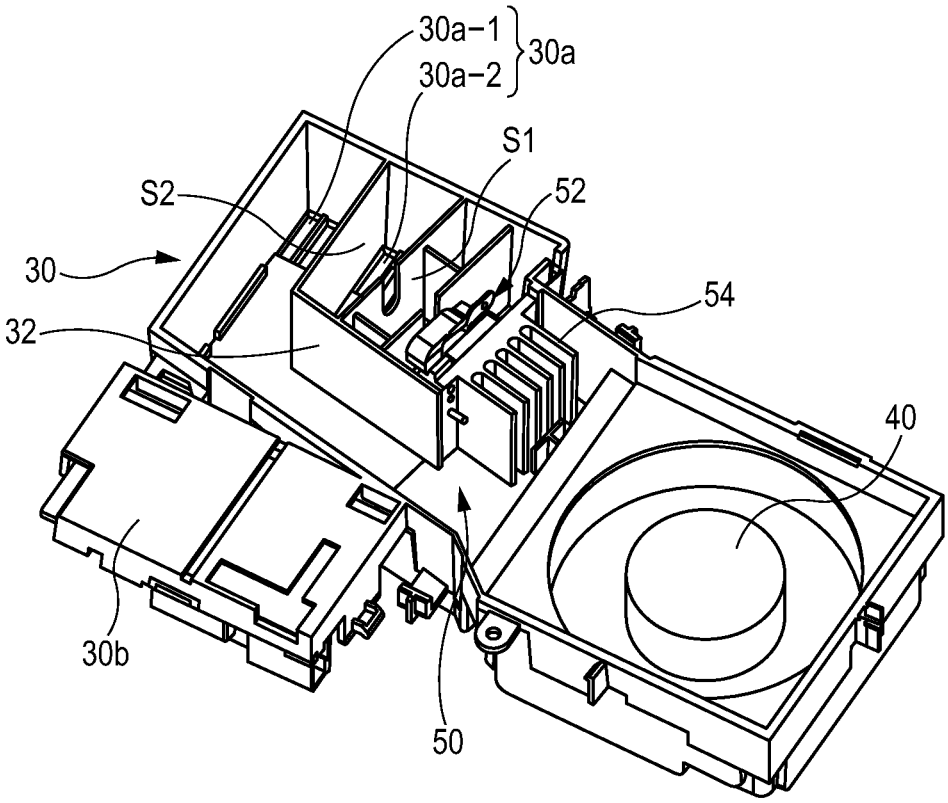
FIG. 5 is a perspective view illustrating the inside of a cover of the ion generating device.
Figure 6:
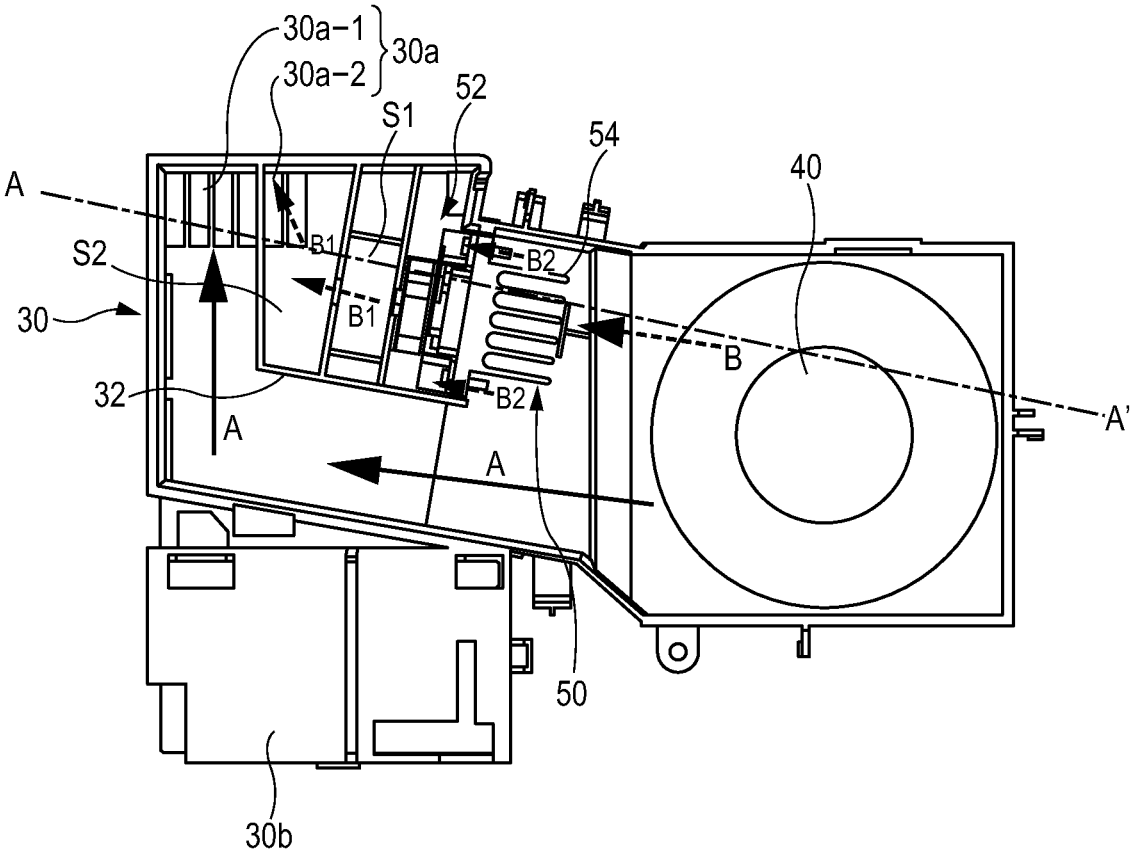
FIG. 6 is a plan view illustrating the inside of the cover of the ion generating device.
Figure 7:
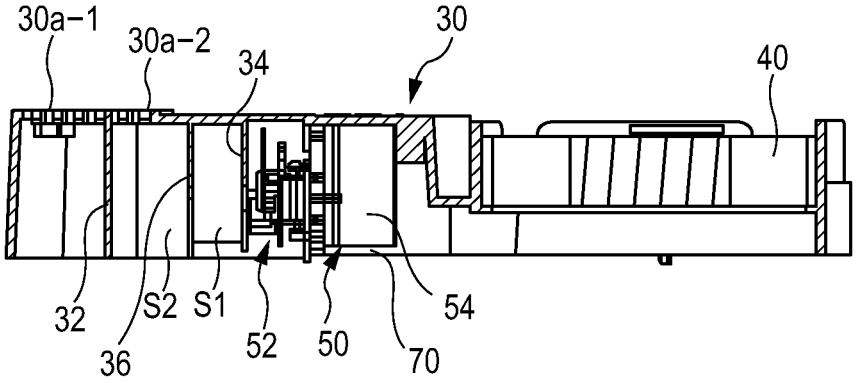
FIG. 7 is a sectional view illustrating the section of A-A' of FIG. 6.

FIG. 5 illustrates the ion generating device 10 of FIG. 3, with the base 20 removed, as viewed from below, and is a perspective view illustrating the inside of the cover 30. FIG. 6 is a plan view illustrating the inside of the cover 30. FIG. 7 is a sectional view illustrating the section of A-A' of FIG. 6.

Inside the cover 30, as an airflow path through which air sucked by the fan 40 flows before being released through the outlet 30*a*, a duct frame is formed. In the duct frame, an ion generator 50 is disposed. The ion generator 50 generates ions in the duct frame.

The duct frame formed in the cover 30 includes an airflow path A (illustrated by solid line arrows A in FIG. 6) through which most of the air sucked by the fan 40 flows to the outlet 30*a*, and an airflow path B (illustrated by dotted line arrows B in FIG. 6) through which a small part of the air sucked by the fan 40 flows. In the airflow path B, the small part of the air sucked by the fan 40 passes through the ion generator 50 and flows to the outlet 30*a* together with ions generated in the ion generator 50.

Specifically, the part of the internal space of the cover 30 through which air from the fan 40 flows is divided by a partition wall 32 into an airflow path A and an airflow path B. That is, the airflow path A and the airflow path B are adjacent. The partition wall 32 extends so as to divide the outlet 30*a*. The outlet 30*a* is divided into an air outlet 30*a*-1 that opens on the airflow path A side, and an ion outlet 30*a*-2 that opens on the airflow path B side.

The ion generator 50 disposed in the airflow path B has an ion generating portion 52 and a radiating fin portion 54. The ion generating portion 52 is provided with the cold side of a Peltier element, and cools air flowing through the airflow path B and condenses moisture. The moisture generated in the Peltier element is decomposed by electric discharge, and ions are generated. The hot side of the Peltier element is connected to the radiating fin portion 54.

The ion generator 50 is disposed in the airflow path B such that a minute gap 70 is formed between the radiating fin portion 54 and the base 20 (with the cover 30 attached to the base 20). That is to say, the airflow path B includes this minute gap 70, and the amount of air flowing through the airflow path B is limited by this minute gap 70. That is to say, this minute gap 70 is a part that provides a very high flow path resistance in the airflow path B, and the dynamic pressure of the airflow generated by the fan 40 is insufficient to cause air to pass through this minute gap 70.

The airflow path B is connected to the ion outlet 30*a*-2. Air containing ions in the airflow path B is pulled by a large amount of air released through the air outlet 30*a*-1 of the airflow path A, and thereby negative pressure is generated in the part of the airflow path B in front of the ion generator 50. The part of the airflow path B in front of the ion generator 50 (B1 illustrated in FIG. 6) is the part of the airflow path B between the above-described minute gap 70 and the ion outlet 30*a*-2. Owing to this negative pressure generated in front of the minute gap 70, air in the part of the airflow path B behind the ion generator 50 (B2 illustrated in FIG. 6) can flow through the minute gap 70 into the part of the airflow path B in front of the ion generator 50. Therefore, the amount of air that can flow into the part of the airflow path B in front of the ion generator 50 is very small.

In this embodiment, the above-described minute gap 70 is formed between the radiating fins 54 and the base 20, and thereby a part having a high flow path resistance is provided behind the ion generating portion 52. However, a part having a high flow path resistance can also be formed in another manner, for example, by providing a minute through-hole in the radiating fin portion 54.

As described above, the moisture in the air entering the ion generating portion 52 of the ion generator 50 through the minute gap 70 is decomposed by electric discharge, and ions are generated. At this time, ozone is also generated by ionization of the moisture.

In front of the ion generating portion 52, a partition wall 34 having a small opening formed therein is provided. In front of the partition wall 34, a partition wall 36 having a small opening formed therein is provided. Therefore, air containing ions and ozone generated in the ion generating portion 52 first accumulates in a space S1 formed between the partition walls 34 and 36. Owing to the negative pressure generated by the large amount of air released through the air outlet 30*a*-1 of the airflow path A, the air containing ions and ozone accumulated in the space S1 moves gradually to the space S2 through the opening of the partition wall 36. The air containing ions and ozone is pulled by the large amount of air released through the air outlet 30*a*-1 and is released from the space S2 through the ion outlet 30*a*-2 to the outside of the ion generating device 10.

The ozone generated in the ion generating portion 52 has high activity, and releasing the ozone from the ion generating device 10 is undesirable. So, in this embodiment, as described above, air containing ions and ozone generated in the ion generating portion 52 goes out gradually through the ion outlet 30*a*-2 after passing through the spaces S1 and S2. While passing through the spaces S1 and S2, most of the ozone is decomposed into oxygen. When released through the ion outlet 30*a*-2, the ozone is almost decomposed. Therefore, the release of active ozone from the ion generating device 10 is suppressed.

In the ion generating portion 52, moisture is ionized by electric discharge, and ions are generated. If the sound accompanying electric discharge (electric discharge sound) is released from the ion generating device 10, it may be noisy. However, in this embodiment, the space S1 is formed in front of the ion generating portion 52 by the partition walls 34 and 36 having small openings, and therefore the electric discharge sound generated in the ion generating portion 52 can be trapped in the space S1 and damped. Therefore, the level of the electric discharge sound going out through the ion outlet 30*a*-2 can be reduced. If a sound insulating material such as sponge is disposed in the space S1, the level of the electric discharge sound can be further reduced.

As described above, the duct frame of the ion generating device 10 according to this embodiment includes an airflow path A and an airflow path B separated by a partition wall 32, and an ion generator 50 is disposed in the airflow path B. The airflow path B is divided into a front flow path between the ion generator 50 and the outlet 30*a*-1, and a rear flow path between the fan 40 and the ion generator 50. That is to say, the airflow path B is divided into a front flow path and a rear flow path by the ion generator 50, and the front flow path and the rear flow path are connected by a minute gap 70 (minute flow path). The minute gap 70 has a very high flow path resistance, and the amount of air passing through the minute gap 70 is very small. Therefore, through the minute gap 70 having a very high flow path resistance, a minute amount of air is supplied to the front flow path provided with the ion generating portion 52 of the ion generator 50. Thus, ions generated in the ion generating portion 52 can be gradually released after being accumulated in the spaces S1 and S2 of the front flow path, and the ozone concentration in the ion-containing air going out through the ion outlet 30*a*-2 can be sufficiently reduced. In addition, since a large amount of air sucked by the fan 40 flows to the airflow path A via the radiating fin portion 54 of the ion generator 50, the radiating fin portion 54 connected to the hot side of the Peltier element can be efficiently cooled. Thus, the cooling effect of the Peltier element can be improved.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment of the present invention has been described in detail, it should be understood that the various changes, substitutions, and alterations could be made hereto without departing from the spirit and scope of the invention.

What is claimed is:

1. A duct frame, comprising:

a first airflow path configured to include a first outlet;

a second airflow path configured to include a second outlet disposed close to the first outlet;

an ion generator configured to be provided in the second airflow path and to divide the second airflow path into a first divided flow path and a second divided flow path; and a minute flow path configured to provide under the ion generator and to have a flow path resistance higher than the flow path resistance of the first divided flow path of the second airflow path.

2. The duct frame according to claim 1, wherein the first airflow path and the second divided flow path of the second airflow path are connected on an air supply side.

3. The duct frame according to claim 1, wherein the minute flow path includes a minute gap formed between part of the ion generator and a wall surface configured to form the second airflow path.

4. The duct frame according to claim 1, wherein the first divided flow path of the second airflow path includes a space in which air configured to contain ions generated by the ion generator accumulates.

5. The duct frame according to claim 1, wherein the space is divided into a first space on the ion generator side and a second space on the second outlet side by a partition wall that opens.

6. The duct frame according to claim 1, wherein the ion generator includes a radiating fin portion provided in the second divided flow path of the second airflow path.

7. An ion generating device, comprising:

a duct frame including a first airflow path configured to include a first outlet, a second airflow path configured to include a second outlet disposed close to the first outlet, an ion generator configured to be provided in the second airflow path and to divide the second airflow path into a first divided flow path and a second divided flow path, and a minute flow path configured to be made under the ion generator and to include a flow path resistance higher than the flow path resistance of the first divided flow path of the second airflow path;

a case configured to form the duct frame; and an air blower configured to be provided in the case and to supply an airflow to the duct frame.

8. The ion generating device according to claim 7, wherein the first airflow path and the second airflow path are divided by a partition wall formed to the case.

* * * * *